US005593192A

United States Patent [19]

Stuchinsky

[11] Patent Number: 5,593,192

[45] Date of Patent: Jan. 14, 1997

[54] CABINET DOOR LATCH

[76] Inventor: Yoram Stuchinsky, 5502 Costello Ave., Sherman Oaks, Calif. 91401

[21] Appl. No.: 529,446

[22] Filed: Sep. 18, 1995

[51] Int. Cl.[6] ..... E05C 3/04

[52] U.S. Cl. ..... 292/207; 292/163; 292/341.15; 292/DIG. 72

[58] Field of Search ..... 292/DIG. 72, 341.15, 292/163, 207

[56] References Cited

U.S. PATENT DOCUMENTS

| | | | |
|---|---|---|---|
| 1,020,437 | 3/1912 | Nelson | 292/DIG. 72 X |
| 1,802,552 | 4/1931 | Corcoran | 292/DIG. 72 X |
| 2,750,219 | 6/1956 | Bleam | 292/DIG. 72 X |
| 3,890,814 | 6/1975 | Fantoni | 292/DIG. 72 X |
| 4,109,950 | 8/1978 | Amdal | 292/DIG. 72 X |
| 4,863,208 | 9/1989 | Streett | 292/DIG. 72 X |

*Primary Examiner*—Rodney M. Lindsey
*Attorney, Agent, or Firm*—Roger A. Marrs

[57] ABSTRACT

A door latch is disclosed herein having a base member with a forward angular and notched face and which includes a sleeve resiliently supporting a reciprocating plunger operable to releasably engage and disengage with a retaining opening provided in a latch member. A spring carried, on the latch member effects forcible separation of the latch member from the base member upon disengagement of the plunger from the latch member opening. Apertures in the base member allow mounting of the base member for either right or left hinge mounted cabinet doors.

7 Claims, 1 Drawing Sheet

CABINET DOOR LATCH

BACKGROUND OF THE INVENTION

1. Field of the Invention

The present invention relates to the field of door closures, and more particularly to a novel manually releasable latch for holding a door in its closed position and which includes means for forcibly urging the door open when manually released.

2. Brief Description of the Prior Art

In the past, it has been the conventional practice to use any one of a variety of door closures in order to releasably hold a hinged door in its closed position. Some of these prior devices rely on magnets, spring clips and turning latches or the like. Problems and difficulties have been encountered with such conventional devices which stem largely from the fact that the latch closure is not positive and in the event of violent shaking, such as in an earthquake, the latch may open to release whereby the contents of a cabinet or the like may fall or separate from the cabinet. Although some conventional latches provide for automatic closure when the door is in its closed position, few, if any, latch mechanisms provide for automatic opening such as forcibly urging the door to an open position when the latch has been manually released. In other instances, plastic hooks have been employed which permit partial opening of the door with respect to the cabinet but which further requires manual dexterity to unlatch the hook from its closure member.

Therefore, a long-standing need has existed to provide a novel latching mechanism which permits automatic latching of a door to a cabinet in a closed position and which permits forcible opening of the door when the latch is manually released. The latch mechanism is to be positive such that shaking or other movement of the hinged door will not release the latch mechanism.

SUMMARY OF THE INVENTION

Accordingly, the above problems and difficulties are avoided by the present invention which provides a novel latch mechanism comprising an elongated base fixedly secured to the cabinet and which includes a resilient plunger that is normally biased into interference with a latch member carried on a hinged door. The latch member includes a sloped or inclined ramp slidably engageable with the tip of the plunger and which further includes an opening to receive the plunger as the plunger passes the ramp during a door closure. The base member further includes an angular front face with an elongated notch that is engaged by a spring means, such as a spring wire carried on the latch member so that when the plunger is manually removed from the opening in the latch member, the spring expands forcibly urging the door to an open position. The expansion spring can be located for right or left hinged doors and the movable plunger and its spring are contained within a sleeve carried on the cabinet.

Therefore, it is among the primary objects of the present invention to provide a novel door closure and latch mechanism which includes means for holding a hinged door in a positive closed position with respect to a cabinet when closed, and which includes a resilient means for forcibly urging the door to an open position when released.

Another object of the present invention is to provide a novel positive enclosure device for maintaining a hinged door in a closed position with respect to a cabinet and which further includes a spring-loaded plunger removably engageable with a latch member and which further includes a resilient means for forcibly urging the hinged door to an open position when the plunger is disconnected from the latch member.

Another object of the present invention resides in providing a hinged door closure latch mechanism which is suitable for mounting onto a cabinet whether the door is mounted from the left or the right.

Yet another object of the present invention resides in providing a positive and releasable latch mechanism which is easy to install and does not require special knowledge or tools for installation.

A further object resides in providing an adjustment for spring tension placed on a latch means so that the user can set the amount of spring-back desired for door opening when the latch mechanism has been released.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
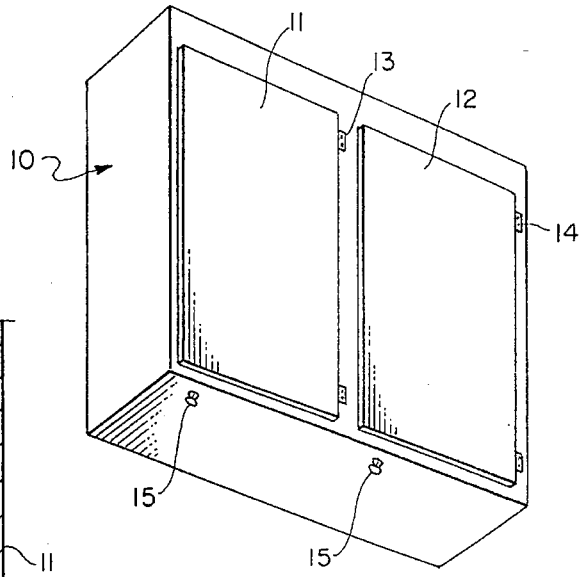
FIG. 1 is a perspective view of a cabinet having conventionally hinged doors and illustrating a portion of the latch mechanism extending from the cabinet in accordance with the present invention.

Referring to FIG. 1, a conventional cabinet is indicated by numeral 10 which includes a pair of doors 11 and 12 which are respectively hinged to the cabinet, such as by hinges 13 and 14 respectively. The hinged doors are illustrated in their closed position and are maintained in the closed position by positive latch mechanism hidden from view when the doors are closed except for a manually release plunger 15.

Figure 2:
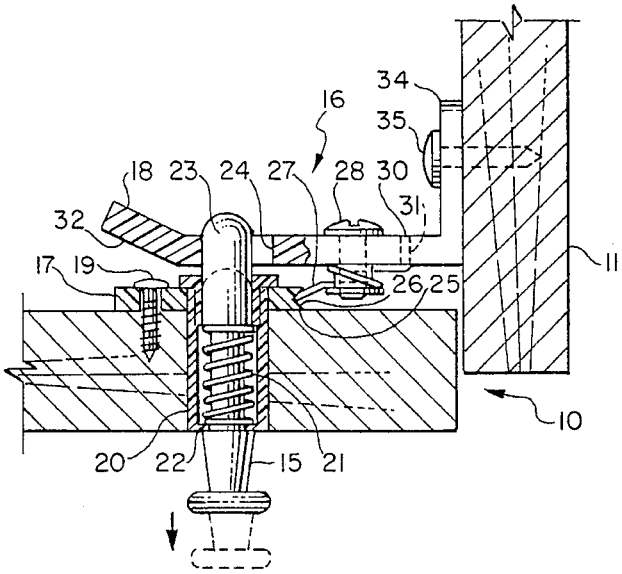
FIG. 2 is an enlarged cross-sectional view of the latch mechanism used in the cabinet and hinged door construction shown in FIG. 1.

Referring now in detail to FIG. 2, the latch mechanism is illustrated in the general direction of arrow 16 which includes a base member 17 and a latch member 18. The base member 17 is fixedly secured to the cabinet 10 by means of screws 19 or the like and the base member includes a downwardly depending sleeve 20 mounting the plunger 15 and an expansion spring 21. The spring 21 is of the coil type and is compressed between a shoulder 22 carried on the sleeve 20 and the underside of a rounded tip 23 of the plunger.

It is noted that the latch member 18 includes an opening 24 through which the rounded tip 23 of the plunger 15 is inserted when the hinged door is in its closed position. The position of the plunger and the rounded tip 23 within the opening 24 secures the hinged door in the closed position.

Figure 3:
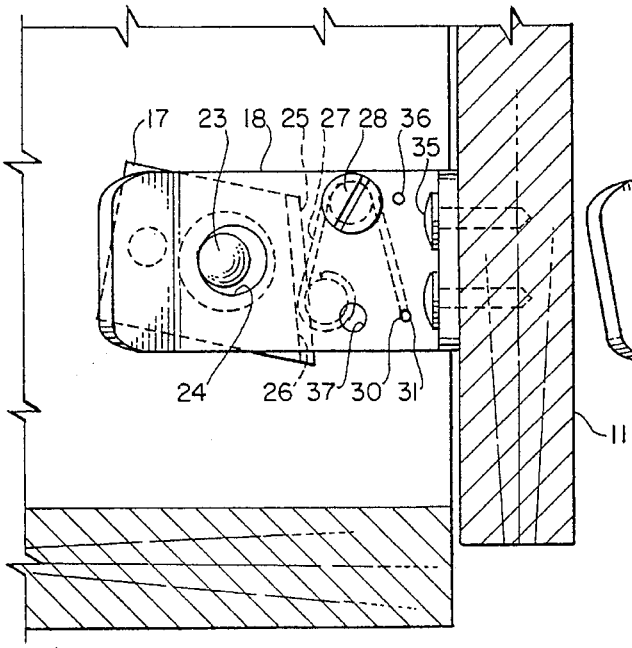
FIG. 3 is a top plan view of the latch mechanism illustrated in its positive latching condition holding the hinged door against the cabinet.

FIG. 2 further illustrates that the front face of the base member 17, as indicated by numeral 25, includes a notch 26. The front face 25 faces the hinged door 11 and is in alignment to receive a cantilevered end of a wire spring 27 carried on a set screw 28. As illustrated in FIG. 2 and 3, the end of the spring 27 bears against the notch 26 in the front face 25 and is therefore compressed. The opposite end of the spring is fixed by having a bent end 30 occupied in a hole 31.

It can be seen that one end of the latch member 18 includes an inclined or sloping ramp 32 which is adapted to be aligned with the rounded tip 23 so that when the hinged door 11 is closed, the rounded tip 23 will ride against the incline surface 32 of the ramp and will cause the plunger to withdraw within its sleeve until the rounded tip aligns or registers with the opening.24. At this time, the compressed spring 22 will forcibly urge the plunger upwardly so that the rounded tip occupies the opening 24 and prevents the hinged door 11 from opening. The opposite end of the latch member 18 from its end carrying ramp 32 includes a flange 34 which is secured to the inside surface of the hinged door 11 by any suitable fastener means such as a screw, nail or the like. The fastener is indicated by numeral 35. When it is desired to release the latched mechanism so that the hinged door 11 may be opened, then the plunger 15 is manually grasped by the fingers of the user about its exposed portion beneath the cabinet 10 and the plunger is moved to the broken line position in the direction of the arrow. This withdraws the plunger and the rounded tip 23 from the opening 24. At this time, the spring 27 will expand, forcibly urging the hinged door to open in the direction of the arrow shown in FIG. 4.

Figure 4:
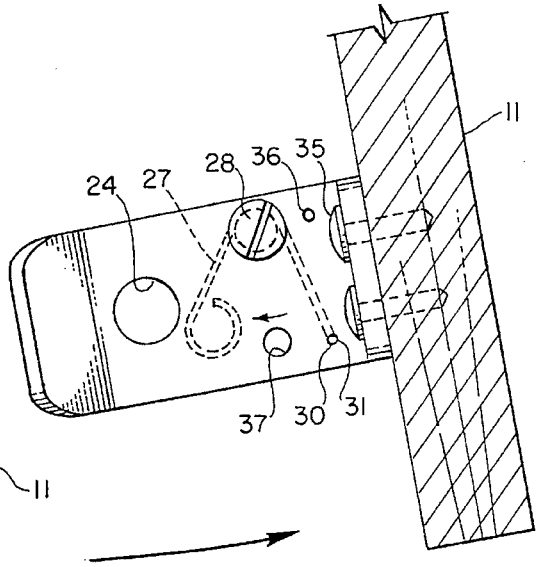
FIG. 4 is a view similar to the view in FIG. 3 illustrating the latch mechanism as being released so as to positively urge the hinged door to an open position in the direction of the arrow.

Referring to FIGS. 3 and 4 in detail, it can be seen that the base member 18 provides that the front face 25 be angular and that a pair of spring end openings are provided for the spring 27. For example, when the door is hinged on its right hand side, the end of the wire spring 30 is projected into the opening 31. However, for left-handed hinged doors, the spring end can be reversed and projected into another hole identified by numeral 36 on the opposite side of the base member. In FIG. 3, the spring 27 is illustrated in its compressed position with respect to the fixed fastener 28 while in FIG. 4, the spring 28 is fully expanded and has separated from the base member. In addition to the holes 31 and 36 for right and left-handed hinged doors, an alternate opening 37 is provided for the spring fastener 28 which permits the spring to be reversed for either right or left-handed usage.

In view of the foregoing, it can be seen that a positive latch is provided for maintaining the hinged door in its closed position. However, when the plunger 15 is manually pulled in a downward position, the tip 23 of the plunger releases the latch member 18 since it is withdrawn from the opening 24 and this permits the expansion of spring 27 to forcibly urge the hinged door 11 outwardly.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A cabinet door latch comprising:

a stationary base member;

a movable latch member adapted to engage and disengage with said base member;

a plunger movably disposed on said base member;

resilient means operably carried between said base member and said plunger normally biasing said plunger into an engagement position with said latch member;

said latch member having opposite ends separated by a midsection with an opening in said midsection;

said plunger insertably receivable in said midsection opening to engage said latch member in said engagement position; and resilient means carried on said latch member engageable with said base member to separate said latch member from said base member when said plunger is disengaged from said latch member.

2. The invention as defined in claim 1 wherein:

said resilient means includes a wire spring having a coil middle portion and opposite ends joined by said middle portion;

said coil middle portion attached to said latch member with said opposite ends outwardly extended with one end secured to said latch member and said other end cantilevered outwardly to compressively interfere with said base member when said plunger is in said engagement position.

3. The invention as defined in claim 2 whereby:

said compressed end of said resilient wire spring forcibly urges said latch member away from said base member when said plunger is disengaged from said latch member.

4. The invention as defined in claim 3 wherein:

said base member includes a forward face having a notch in said forward face in the path of said wire spring and engageable therewith to compress said respective end of said wire spring.

5. The invention as defined in claim 4 wherein:

said secured end of said wire spring having a segment secured in a hole in said latch member.

6. The invention as defined in claim 5 including:

wire spring mounting holes provided in said latch member for accommodating right and left hand mounting of said wire spring.

7. The invention as defined in claim 6 wherein:

a selected end of said latch member includes a mounting flange and the other end includes a slopping ramp slidably engageable with said plunger;

said plunger having a rounded tip interfering with said ramp whereby said ramp forces said plunger to move until aligned with said latch member midsection opening.

* * * * *